US006099296A

United States Patent [19]

Wang

[11] Patent Number: 6,099,296

[45] Date of Patent: Aug. 8, 2000

[54] SAFETY MECHANISM OF LIGHTER

[76] Inventor: Jyh-Shenq Wang, No. 22, Lane 96, Chiao-Hsin Rd., Hsin-Tien City, Taipei Hsien, Taiwan

[21] Appl. No.: 09/121,464

[22] Filed: Jul. 23, 1998

[51] Int. Cl.[7] ..... F23Q 2/34

[52] U.S. Cl. ..... 431/153; 431/276

[58] Field of Search ..... 431/153, 276, 431/277

[56] References Cited

U.S. PATENT DOCUMENTS

| | | | |
|---|---|---|---|
| 3,063,276 | 11/1962 | Cassan | 431/277 |
| 3,719,447 | 3/1973 | Dessoy | 431/277 |
| 5,490,773 | 2/1996 | Lloveras Capilla | 431/153 |
| 5,584,683 | 12/1996 | Sher | 431/153 |
| 5,634,787 | 6/1997 | Frigiere | 431/153 |
| 5,676,537 | 10/1997 | Fang | 431/153 |

*Primary Examiner*—Ira S. Lazarus
*Assistant Examiner*—Sara Clarke
*Attorney, Agent, or Firm*—Bucknam and Archer

[57] ABSTRACT

An improved safety mechanism of a lighter contains an idle wheel with coarse grains, pivoted on two ratchet arms on the top end face of the lighter; a seat right below the idle wheel; a tension spring received within the seat and a flint bar provided between the tension spring and the idle wheel. The oval axle of the idle wheel of an oval shape is loosely inserted in a smaller hole at the upper portion of an egg shaped slot on the two ratchet arms, the portion of the egg shaped slot being bigger gradually downward. Upon lighting up, an appropriate counterbalance force against the spring tension is applied for the oval axle of the idle wheel to shift downward into the lower portion of the egg shaped slot and then the idle wheel may be rotated to rub against the flint bar to effect ignition.

2 Claims, 4 Drawing Sheets

SAFETY MECHANISM OF LIGHTER

FIELD OF THE INVENTION

This invention relates to an improved safety mechanism of a lighter, particularly to the one which upon lighting up requires an appropriate pressing down force to shift downward an idle wheel to a position where the idle wheel may be rotated to light up. Since to effect lighting up requires first to press down the idle wheel and second to rotate the idle wheel, the risk that the children playing with the lighter may accidentally light up to cause a fire is therefore prevented.

BACKGROUND OF THE PRIOR ART

As shown in FIGS. 1 & 2, a conventional lighter 1 comprises an idle wheel 11 rotatably pivoted on two ratchet arms on the top end of the lighter; and a tension spring below the idle wheel 11 acting upon a flint bar which biases against the coarse circumference of the idle wheel. Upon lighting up, the gas flowing out of a gas nozzle 13 may be ignited by rotating the idle wheel with the thumb to rub against the flint bar and simultaneously pressing down a pressing plate. Such a lighter is simple in structure, more convenient in usage, and, due to mass production, more popular in availability. However, it is also accompanied by with a risk that children playing with such a lighter may accidentally cause a fire.

SUMMARY OF THE INVENTION

In view of the above, the object of this invention is to provide an improved safety mechanism of a lighter wherein the a central axle of an idle wheel is of an oval shape and is pivoted in an egg shaped slot on two ratchet arms on the top end of the lighter. The upper portion of the egg shaped slot is relatively small and slightly bigger than the short axis of the oval axle; whereas the lower portion is relatively large and slightly bigger than the long axis of the oval axle. In a normal position, the tension spring biases the flint bar against the idle wheel and the oval axle is loosely inserted in the upper portion of the egg shaped slot. Upon lighting up, the idle wheel has to be pressed down first for the oval axle to shift within the lower portion of the egg shaped slot and then the idle wheel is rotated to rub against the flint bar to effect lighting up. Thus, any accidental rotation of the idle wheel by the children to light up is effectively prevented.

According to the present invention, a slight alteration to an original manufacturing mold is needed which does not increase the production cost; and this is another objects of the present invention. Any other objects, features and advantages will be more apparent from the following description made with reference to the accompanied drawings, wherein:

A BRIEF DESCRIPTION OF THE DRAWINGS

DETAILED DESCRIPTION OF THE PREFERRED EMBODIMENTS

Figure 2:
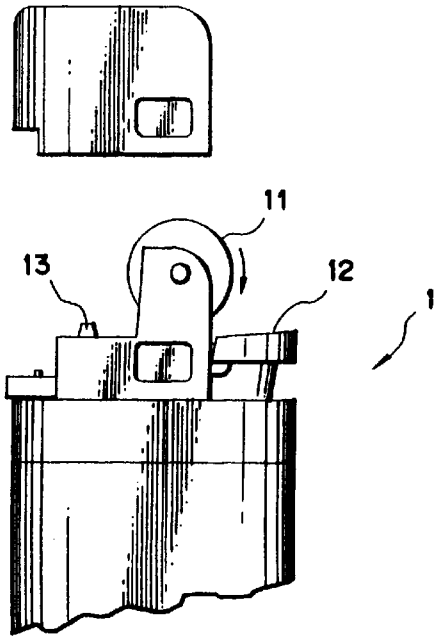
PRIOR ART FIG. 2
FIG. 2 is a partially exploded view of the conventional lighter.
Figure 1:
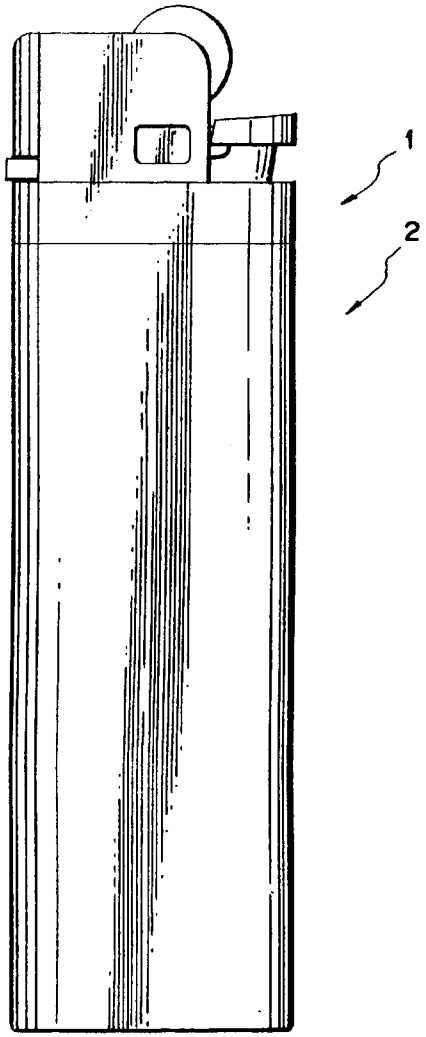
PRIOR ART FIG. 1
FIG. 1 is a front external view of a conventional lighter incorporating the structure of this invention.
Figure 3:
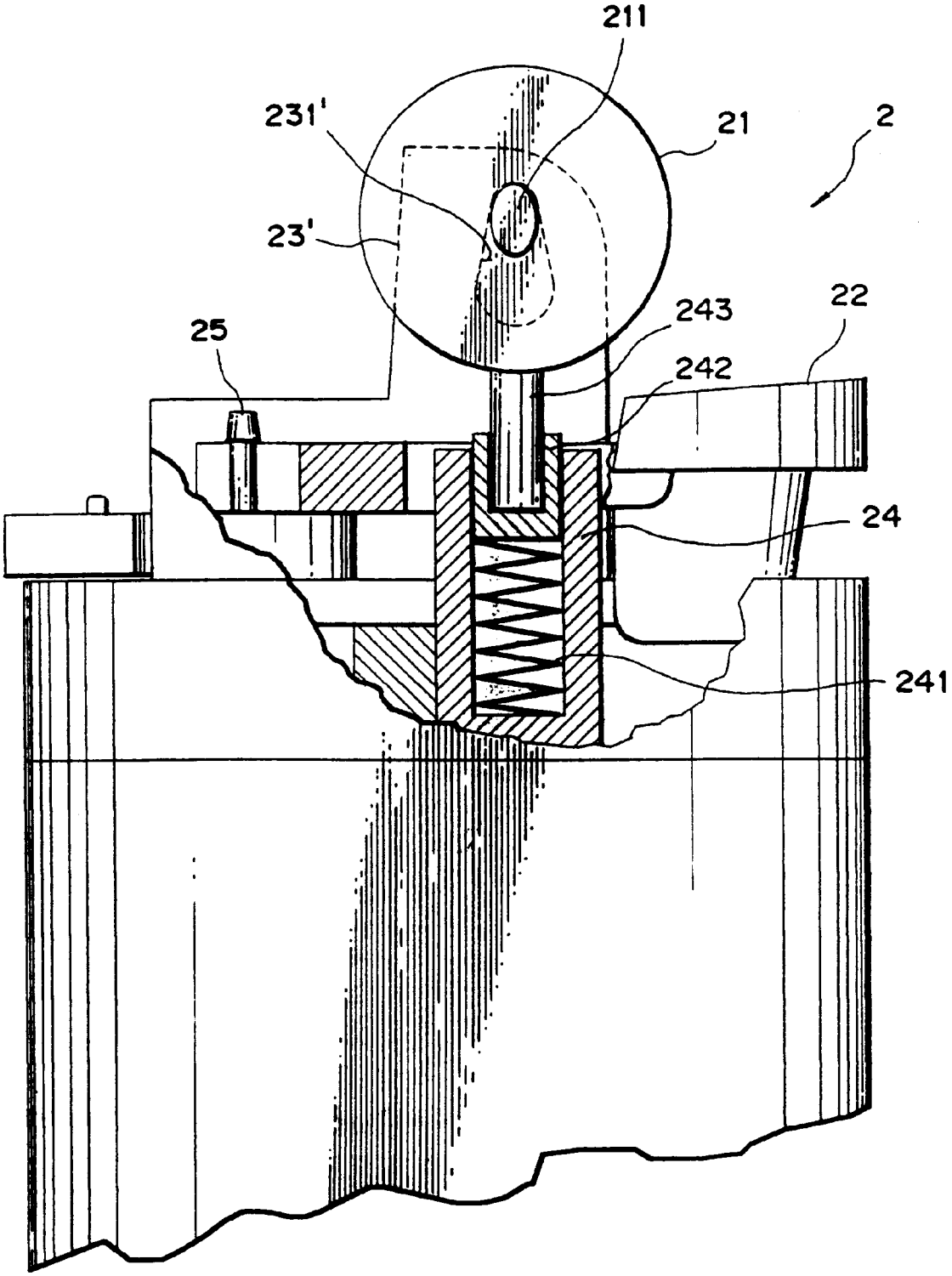
FIG. 3 is a partially sectional view of a lighter according to this invention illustrating a position wherein a flint bar acts against the lower edge of an idle wheel due to the spring force.
Figure 5:
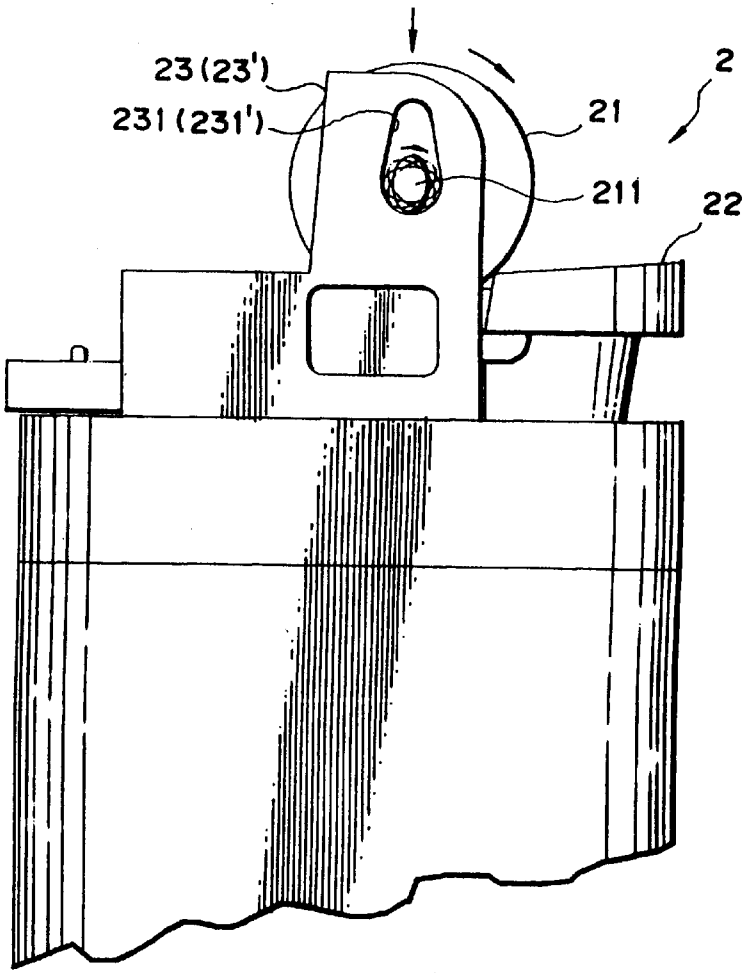
FIG. 5 is a partially schematic view illustrating the use of the condition shifted from FIG. 4, wherein the oval axle starts rotating after when it moves down to the lower portion of the egg shaped slot.
Figure 4:
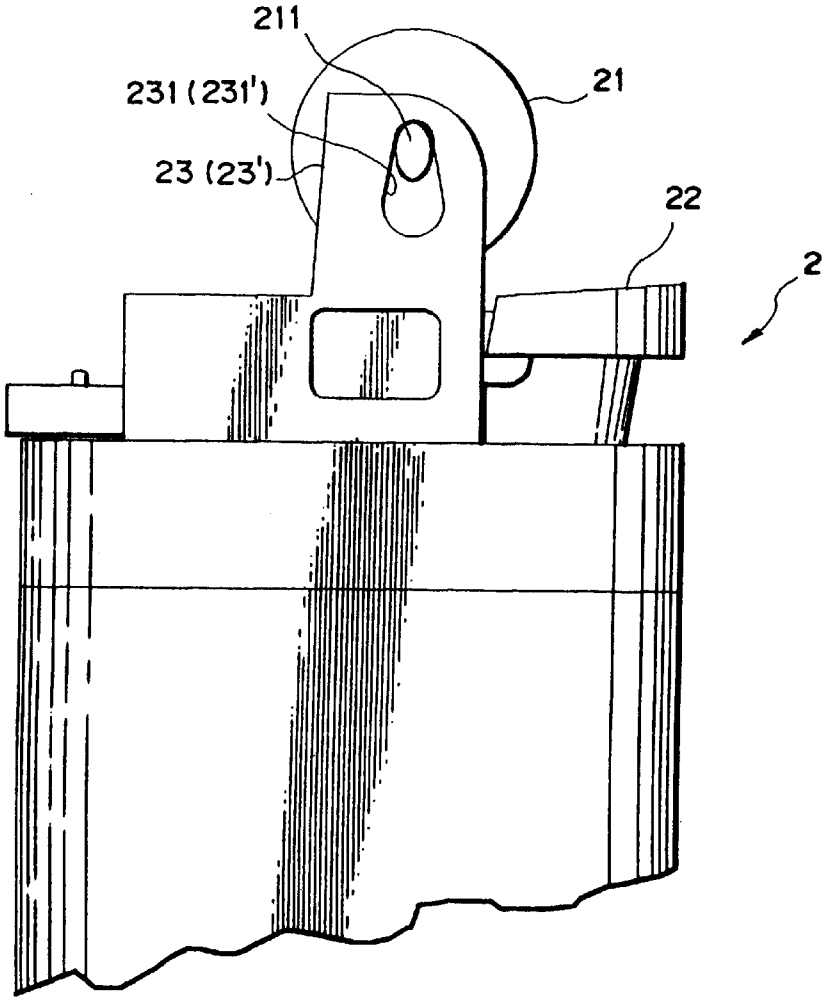
FIG. 4 is a partially schematic view of a lighter in a normal position according to this invention wherein the oval axle of the idle wheel is tightly engaged with the upper portion of an egg shaped slot.

As shown in FIGS. 1 & 2, a conventional lighter 1 is provided with ignition means on the top and a cavity containing therein liquid gas. Further, referring to FIGS. 3, 4 and 5, a safety mechanism of lighter 2 according to this invention also comprises a conventional idle wheel 21 having coarse grains along its circumference. However, the present invention is different from the conventional one in that the section of the oval axle 211 is of oval shape and the oval axle 211 is pivoted in egg shaped slots 231, 231' on two ratchet arms 23, 23' at the top end face of the lighter 2. The oval axle 211 is loosely inserted into the egg shaped slots 231, 231' wherein the upper portion of the egg shaped slots 231, 231' is relatively small and slightly bigger than the short axis of the oval axle 211 of the idle wheel, while the lower portion of the egg shaped slots 231, 231' is relatively large and slightly bigger than the long axis of the oval axle 211. As shown in FIG. 3, a seat 24 is provided right below the idle wheel 21 to receive a tension spring 241 therein, and between the tension spring 241 and the idle wheel 21, a flint bar 243 connected to a grooved base 242 is received within the seat 24 with the bottom portion of the grooved base 242 biasing against the front end of the tension spring 241. In a normal position, the tension spring 241 acts upon the grooved base 242 to urge the flint bar 243 tightly against the surface of the idle wheel 21, and the oval axle 211 of the idle wheel 21 is engaged with the upper portion of the egg shape slots 231, 231' whereby the idle wheel 211 may not rotate. As shown in FIG. 5, upon lighting up, an appropriate counterbalance force against the spring tension is applied on the oval axle 211 of the idle wheel 21 to shift downward into the lower portion of the egg shaped slots 231, 231' whereby the idle wheel 21 rubs against the flint bar 243 to ignite a gas nozzle 25, then a pressing plate 22 is pressed down continuously, the gas may ceaselessly flow out from the gas nozzle 25. The subsequent step may be carried out by using the thumb to rotate the idle wheel, and no inconvenience will result for the adult. However, children whose exerting force is so weak and who have no idea about pressing down consequently they are not capable of rotating the idle wheel 21 to effect ignition.

Figure 7:
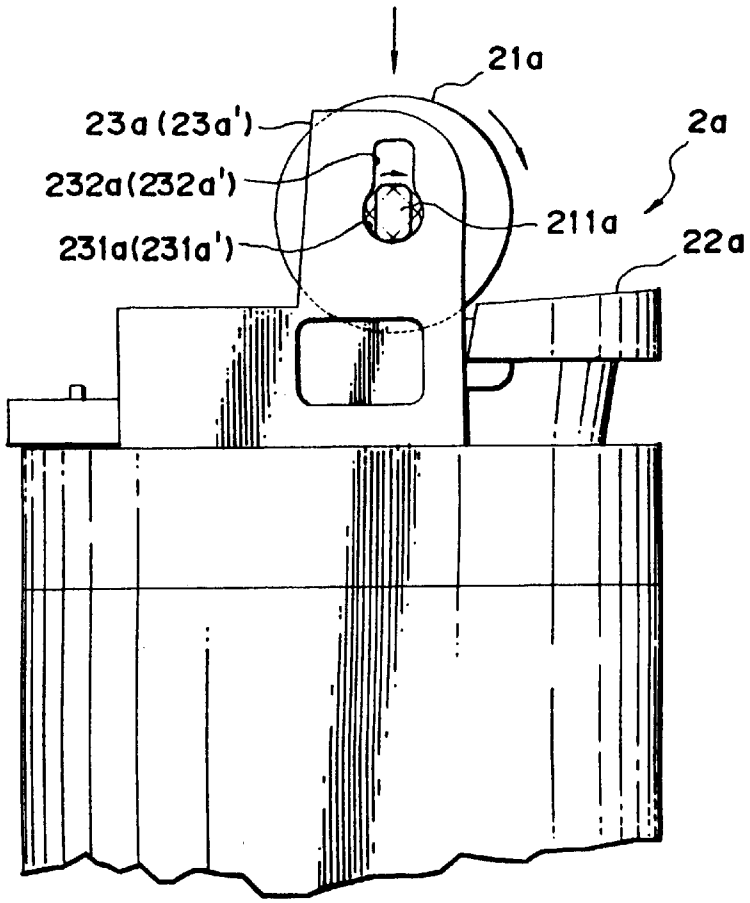
FIG. 7 is a partially schematic view showing the use of the condition shifted from FIG. 6, wherein the rectangular axle starts rotating after when it moves down into the elliptic slot.
Figure 6:
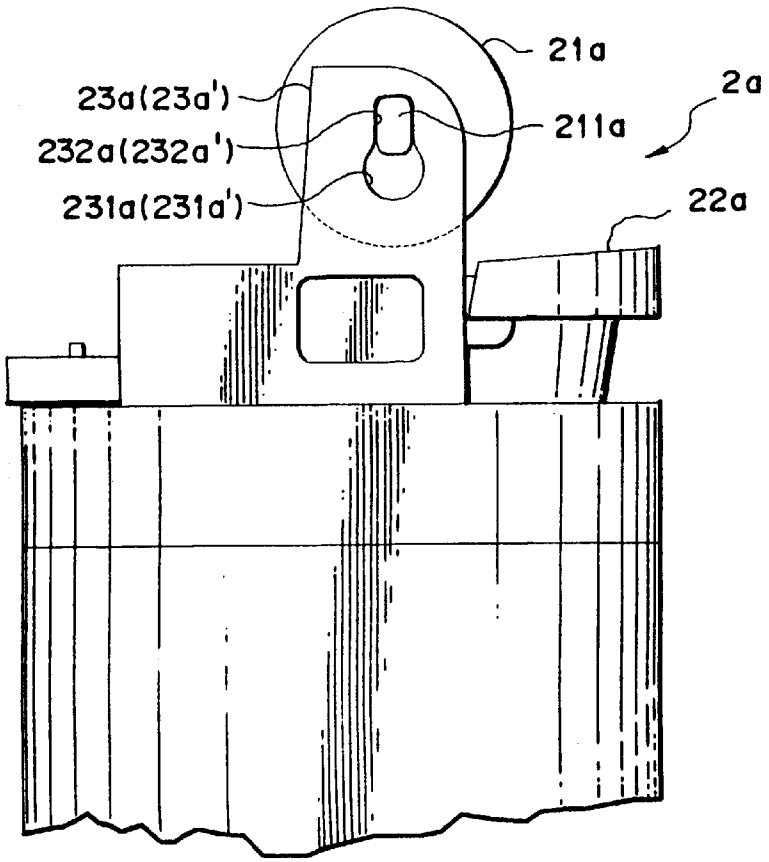
FIG. 6 illustrates another embodiment of a lighter according to this invention showing that the central axle of the idle wheel is in a longitudinally long rectangular shape.

FIGS. 6 and 7 show another embodiment of improved safety mechanism 2*a* for lighter 22 according to this invention. The only differences of structure of this embodiment from that illustrated and disclosed above are that a central axle 211*a* of an idle wheel 21*a* is of a longitudinally long rectangular shape with corners rounded, and the idle wheel 21*a* is rotated in long slots 232*a*, 232*a'* defined by crossed eccentric circular slots 231*a*, 231*a'* on two ratchet arms 23*a*, 23*a'*. The width of the long slots 232*a*, 232*a'* is slightly larger than the horizontal width of the rectangular axle 211*a*, while the diameter of the lower end of the circular slots 231*a*, 231*a'* is slightly larger than the longitudinal length of the rectangular axle 211*a*; and their crossed corners are rounded. FIG. 6 shows a normal position wherein the tension spring acts upon the flint bar which biases tightly against the lower edge of the idle wheel 21*a*, while the rectangular axle 211*a* is inserted into the long slots 232*a*, 232*a*'. Upon lighting up, as shown in FIG. 7, a counterbalance force against spring tension is applied for the rectangular axle 211*a* of the idle wheel 21*a* to shift downward into the circular slots 231*a*, 231*a*' whereby the idle wheel 21*a* can be rotated to rub against the flint bar to ignite the gas nozzle.

While the invention is described in its preferred form with a certain degree of particularity, obviously many changes and variations are possible therein. It is therefore to be understood that the present invention may be practiced otherwise than as specifically described herein without departing from the spirit and scope thereof.

What is claimed is:

1. A lighter of improved safety, comprising:

an idle wheel (21) having course grains along the circumference thereof;

two ratchet arms (23,23') disposed on a top surface of the lighter each having an egg shaped slot (231,231') therein, each said egg shaped slot having an upper portion and a lower portion;

an axle (211) on which said idle wheel is mounted, said axle having an oval shape with a minor axis and a major axis, said axle being mounted in the egg shaped slots (231,231') of said two ratchet arms (23,23');

a seat (24) positioned below said idle wheel;

a tension spring (241) received within said seat (24);

a flint bar (243) being connected to a grooved base (242) received within said seat (24) so that said tension spring (241) acting on said grooved base (242) urges said flint bar (243) against said idle wheel (21), the upper portion of said egg shaped slots (231,231') being slightly larger than the minor axis of said axle (211) and the lower portion of said egg shaped slots (231,231') being slightly larger than the major axis of said axle (211), so that said axle (211) is disposed in the upper portion of said egg shaped slots (231,231') by the urging of said flint bar (243) against said idle wheel (21) whereby rotation of said axle (211) within said egg shaped slots is prevented and upon application of a force on said idle wheel (21) counter to the bias of said tension spring (241) said axle (211) is disposed in the lower portion of said egg shaped slots (231,231') so that the axle may be rotated to rub against said flint bar (243) to ignite a gas emitted by a gas nozzle (25).

2. A lighter of improved safety, comprising:

an idle wheel (21*a*) having course grains along the circumference thereof;

two ratchet arms (23*a*,23*a*') disposed on a top surface of the lighter each having a long slot (232*a*,232*a*') therein, each slot being defined by a crossed eccentric circular slot (231*a*,231*a*') in a lower portion;

an axle (211*a*) on which said idle wheel is mounted, said axle having a rectangular shape having rounded corners with a short side and a longitudinal length; said axle being mounted in the long slots (232*a*,232*a*') of said two ratchet arms (23*a*,23*a*');

a seat (24) positioned below said idle wheel;

a tension spring (241) received within said seat (24);

a flint bar (243) being connected to a grooved base (242) received within said seat (24) so that said tension spring (241) acting on said grooved base (242) urges said flint bar (243) against said idle wheel (21*a*);

said long slots (232*a*,232*a*') having a width slightly larger than the short side of said rectangular axle (211*a*) and the circular slot (231*a*,231*a*') of the lower portion having a diameter slightly larger than the longitudinal length of said rectangular axle (211*a*), so that said axle (211*a*) is disposed in the long slots (232,232*a*') by the urging of said flint bar (243) against said idle wheel (21*a*) whereby rotation of said axle (211*a*) within said slots is prevented and upon application of a force on said idle wheel (21*a*) counter to the bias of said tension spring (241) said axle (211*a*) is disposed in the lower portion of said circular slots (231*a*,231*a*') so that the axle may be rotated to rub against said flint bar (243) to ignite a gas emitted by a gas nozzle (25).

* * * * *